US011605332B1

(12) United States Patent
Guo et al.

(10) Patent No.: US 11,605,332 B1
(45) Date of Patent: Mar. 14, 2023

(54) MOVING PICTURE RESPONSE TIME (MPRT) TECHNIQUES FOR LIQUID CRYSTAL DISPLAYS (LCDS)

(71) Applicant: Dell Products, L.P., Round Rock, TX (US)

(72) Inventors: Lei Guo, Singapore (SG); Zhinan Chen, Bukit Batok (SG)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 17/650,708

(22) Filed: Feb. 11, 2022

(51) Int. Cl.
*G09G 3/20* (2006.01)
*G09G 3/36* (2006.01)

(52) U.S. Cl.
CPC ..... *G09G 3/2007* (2013.01); *G09G 3/36* (2013.01); *G09G 2320/0233* (2013.01); *G09G 2320/0261* (2013.01); *G09G 2320/0266* (2013.01); *G09G 2360/16* (2013.01)

(58) Field of Classification Search
CPC ..... G09G 3/36; G09G 3/2007; G09G 2320/0233; G09G 2320/0261; G09G 2320/0266; G09G 2360/16
See application file for complete search history.

(56) References Cited

U.S. PATENT DOCUMENTS

2005/0068343 A1* 3/2005 Pan ..... G09G 3/3648 345/690
2006/0181503 A1* 8/2006 Feng ..... G09G 3/342 345/102
2007/0159425 A1* 7/2007 Knepper ..... G09G 3/3611 345/87
2008/0018571 A1* 1/2008 Feng ..... G09G 3/3648 345/87
2008/0079739 A1* 4/2008 Gupta ..... G09G 5/363 345/520
2008/0231579 A1* 9/2008 Vasquez ..... G09G 3/3648 345/98
2017/0124934 A1* 5/2017 Verbeure ..... G09G 3/3611

* cited by examiner

*Primary Examiner* — Kenneth Bukowski
(74) *Attorney, Agent, or Firm* — Fogarty LLP

(57) ABSTRACT

Systems and methods are provided for providing Response Time Compensation (RTC) by generating multiple overdrive look-up tables (LUTs) for a display device are described. In some embodiments, an Information Handling System (IHS) may include a controller and a memory coupled to the controller, the memory having program instructions stored thereon that, upon execution, cause the controller to generate multiple LUTs each having alternate grey levels selected to implement RTC in a Liquid Crystal Display (LCD), wherein the alternate grey levels of each of the LUTs is calculated, at least in part, by taking into account one of a plurality of pixel lines of a video stream.

18 Claims, 10 Drawing Sheets

500b

| 17x17 OD LUT | | TO | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| FROM | 0 | | 21 | 46 | 65 | 81 | 118 | 130 | 153 | 172 | 197 | 220 | 223 | 247 | 248 | 255 | 255 | 255 |
| | 16 | 0 | | 37 | 58 | 78 | 107 | 123 | 147 | 165 | 190 | 212 | 219 | 242 | 244 | 255 | 255 | 255 |
| | 32 | 0 | 11 | | 52 | 73 | 100 | 119 | 140 | 159 | 185 | 209 | 215 | 236 | 242 | 255 | 255 | 255 |
| | 48 | 0 | 9 | 26 | | 68 | 96 | 113 | 135 | 153 | 179 | 204 | 211 | 233 | 239 | 255 | 255 | 255 |
| | 64 | 0 | 8 | 21 | 41 | | 84 | 108 | 129 | 149 | 174 | 199 | 108 | 230 | 236 | 255 | 255 | 255 |
| | 80 | 0 | 7 | 20 | 35 | 59 | | 102 | 124 | 146 | 169 | 195 | 204 | 227 | 233 | 255 | 255 | 255 |
| | 96 | 0 | 7 | 19 | 33 | 54 | 75 | | 118 | 141 | 163 | 187 | 198 | 223 | 231 | 255 | 255 | 255 |
| | 112 | 0 | 6 | 18 | 32 | 52 | 70 | 89 | | 134 | 157 | 175 | 195 | 220 | 229 | 252 | 255 | 255 |
| | 128 | 0 | 6 | 17 | 32 | 51 | 68 | 82 | 106 | | 150 | 168 | 189 | 217 | 226 | 249 | 255 | 255 |
| | 144 | 0 | 5 | 16 | 31 | 50 | 66 | 81 | 100 | 123 | | 162 | 185 | 212 | 223 | 245 | 255 | 255 |
| | 160 | 0 | 5 | 16 | 31 | 50 | 65 | 77 | 98 | 118 | 139 | | 180 | 205 | 219 | 241 | 255 | 255 |
| | 176 | 0 | 4 | 15 | 28 | 47 | 60 | 74 | 96 | 112 | 134 | 155 | | 198 | 216 | 237 | 255 | 255 |
| | 192 | 0 | 3 | 14 | 26 | 47 | 56 | 72 | 92 | 108 | 128 | 150 | 171 | | 213 | 233 | 251 | 255 |
| | 208 | 0 | 3 | 13 | 25 | 43 | 52 | 67 | 88 | 105 | 125 | 144 | 166 | 186 | | 230 | 248 | 255 |
| | 224 | 0 | 3 | 12 | 24 | 40 | 48 | 63 | 85 | 102 | 118 | 141 | 162 | 180 | 203 | | 245 | 255 |
| | 240 | 0 | 2 | 10 | 22 | 38 | 46 | 59 | 83 | 97 | 112 | 131 | 157 | 175 | 198 | 219 | | 255 |
| | 255 | 0 | 1 | 9 | 20 | 35 | 43 | 55 | 79 | 93 | 106 | 121 | 135 | 170 | 194 | 205 | 234 | |

FIG. 5B

MOVING PICTURE RESPONSE TIME (MPRT) TECHNIQUES FOR LIQUID CRYSTAL DISPLAYS (LCDS)

BACKGROUND

As the value and use of information continues to increase, individuals and businesses seek additional ways to process and store information. One option is an Information Handling System (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, global communications, etc. In addition, IHSs may include a variety of hardware and software components that may be configured to process, store, and communicate information and may include one or more computer systems, data storage systems, and networking systems.

IHSs often include (or are coupled to) display devices, such as liquid crystal display (LCD) panels. LCD panels are progressively scanned, meaning that at any given time instant, partial frames of both the previous and current frame are visible on the screen along with a progressively moving tear boundary. This scan and hold characteristic is well-suited for the display of static image content, but may be undesirable for the display of video that contains motion. In general, this is due to the inadequate pixel response times of LCD panels.

Each pixel in an LCD panel includes a column of liquid crystal molecules suspended between two transparent electrodes that are in turn sandwiched between two polarizing filters whose axes of polarity are perpendicular to each other. By applying voltage to the transparent electrodes over each pixel, the corresponding liquid crystal molecules are "twisted" by electrostatic forces, allowing varying degrees of light to pass through the polarizing filters. Due to their electro-optical nature, the liquid crystal materials used in LCD panels have inertia and cannot be switched instantaneously. This results in transition response times that are generally not fast enough for high quality video applications. This slow response time, or latency, can result in video motion artifacts that cause quickly moving objects to appear visually blurred, an effect known as "ghosting" or "smearing."

LCD response times continue to improve, but vendor specifications are generally limited to "off-to-on," "rise and fall," or "black-to-white" response time, which is the time it takes a pixel to change from black to white (rise) and then back to black (fall). The voltage required to change an LCD pixel from black to white, or white to black is often greater than the voltage to change a pixel from one shade of grey to another. This disparity in voltage differential is the reason "black-to-white" response time is much faster than "grey-to-grey" response time, which is defined as the time it takes a pixel to change from one shade of grey to another. Grey-to-grey response times for LCD panels can be many times longer (e.g., 30 to 50 milliseconds.) than corresponding "black-to-white" response times.

Video frame rates are typically on the order of 17 milliseconds. at 60 Hertz, which can be shorter than liquid crystal "grey-to-grey" response time. These frame rates, when combined with motion within the video frame, can result in video artifacts that cause smearing and low video quality. This problem extends to all LCD displays, but it is more of an issue for LCD panels used in portable IHSs due to their typically lower power consumption and correspondingly slow response times. In addition, due to limited battery life, power adapter capacity, cooling limitations, fan noise and other operational and design constraints, portable IHSs are generally designed to efficiently use computation cycles and minimize the associated overhead required to display an image.

Current approaches to address slow pixel response times include LCD Response Time Compensation (LRTC), a technique for mitigating video artifacts that can contribute to smearing when motion video is displayed on a LCD screen. LRTC addresses slow intrinsic response times by imposing an extrinsic overdrive voltage for each pixel to be written, based on the prior and next pixel values and the predetermined characteristics of the LCD panel.

SUMMARY

Systems and methods are provided for providing Response Time Compensation (RTC) by generating multiple overdrive look-up tables (LUTs) for a display device are described. In some embodiments, an Information Handling System (IHS) may include a controller and a memory coupled to the controller, the memory having program instructions stored thereon that, upon execution, cause the controller to generate multiple LUTs each having alternate grey levels selected to implement RTC in a Liquid Crystal Display (LCD), wherein the alternate grey levels of each of the LUTs is calculated, at least in part, by taking into account one of a plurality of pixel lines of a video stream.

According to another embodiment, a Response Time Compensation (RTC) method for a Liquid Crystal Display (LCD) includes the steps of generating multiple Look-up Tables (LUTs) each having alternate grey levels selected to implement RTC in a Liquid Crystal Display (LCD), and calculating the grey levels for each of the LUTs, at least in part, by taking into account one of a plurality of pixel lines of a video stream.

According to yet another embodiment, s memory storage device with program instructions stored thereon that upon execution, cause the LCD to receive a video stream, generate a plurality of Look-up Tables (LUTs) each having alternate grey levels selected to implement Response Time Compensation (RTC) in a Liquid Crystal Display (LCD), and calculate the alternate grey levels of each of the LUTs, at least in part, by taking into account one of a plurality of pixel lines of the video stream.

BRIEF DESCRIPTION OF THE DRAWINGS

The present invention(s) is/are illustrated by way of example and is/are not limited by the accompanying figures, in which like references indicate similar elements.

Elements in the figures are illustrated for simplicity and clarity, and have not necessarily been drawn to scale.

FIGS. 5A and 5B illustrate an example group of multiple overdrive (OD) LUTs that may be used to progressively increase the overdrive (OD) response strength according to one embodiment of the present disclosure.

DETAILED DESCRIPTION

The present disclosure is described with reference to the attached figures. The figures are not drawn to scale, and they are provided merely to illustrate the disclosure. Several aspects of the disclosure are described below with reference to example applications for illustration. It should be understood that numerous specific details, relationships, and methods are set forth to provide an understanding of the disclosure. The present disclosure is not limited by the illustrated ordering of acts or events, as some acts may occur in different orders and/or concurrently with other acts or events. Furthermore, not all illustrated acts or events are required to implement a methodology in accordance with the present disclosure.

According to various embodiments of the present disclosure, systems and methods for generating multiple overdrive look-up tables (LUTs) that provide progressive overdrive compensation for edge-lit LCD display's Moving Picture Response Time (MPRT) are described. By introducing the progressive overdrive based on the pixel lines' position on an LCD display, some, most, or all pixel lines may be able to transit to a common target grey level target ($G_{Target}$) level when the backlight is turned on. Additional techniques for Response Time Compensation (RTC) may include an architecture for implementing current frame-end grey-level luminance information into the RTC frame buffer, and incorporating values as specified by the International Commission on Illumination (CIE) standard (e.g., CIEDE2000) standard into the overdrive (OD) algorithm.

As gaming displays gain popularity in the consumer market, consumers are paying more attention to the response time and motion blur of a display, which can be a pivotal factor in how well the display accurately reproduces imagery generated by games, and in particular action games that can generate quickly moving imagery. Since Liquid Crystal Displays (LCDs) have an inherently poor response time relative to other types (e.g., Organic Light Emitting Diode (OLED) displays, cathode ray tube (CRT) displays, etc.), MPRT has become an important factor in how well LCD displays reduce the perceived motion blur across the screen of the display. This factor has become particularly relevant given that over 90 percent (%) of LCD displays typically incorporate an edge-lit backlight system. The MPRT in current edge-lit LCD displays can only obtain a limited range (e.g., center band) of blur reduction. This limited range is typically due to an orthogonal relation between a pixel line's transition from the top to the bottom of the screen that is still in progress while the edge-lit system's strobing backlight mechanism is turned on.

Figure 1A:
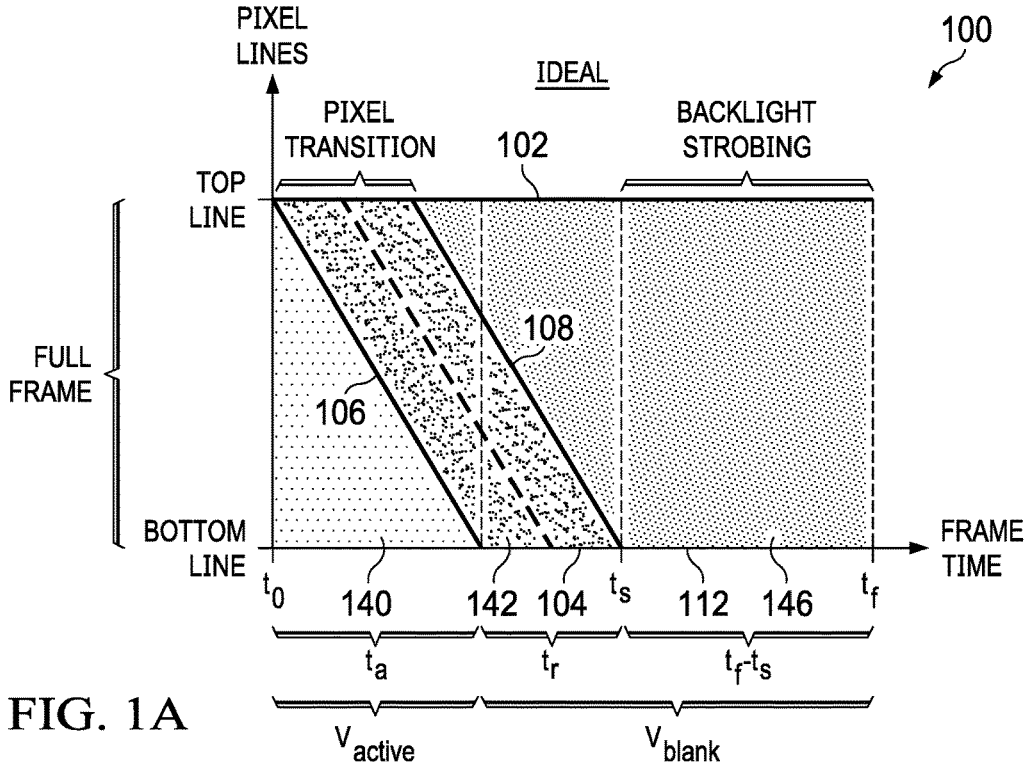
FIGS. 1A and 1B illustrate an ideal progressive frame refresh sequence and an actual progressive frame refresh sequence that occurs in an edge-lit LCD display according to one embodiment of the present disclosure.
Figure 1B:
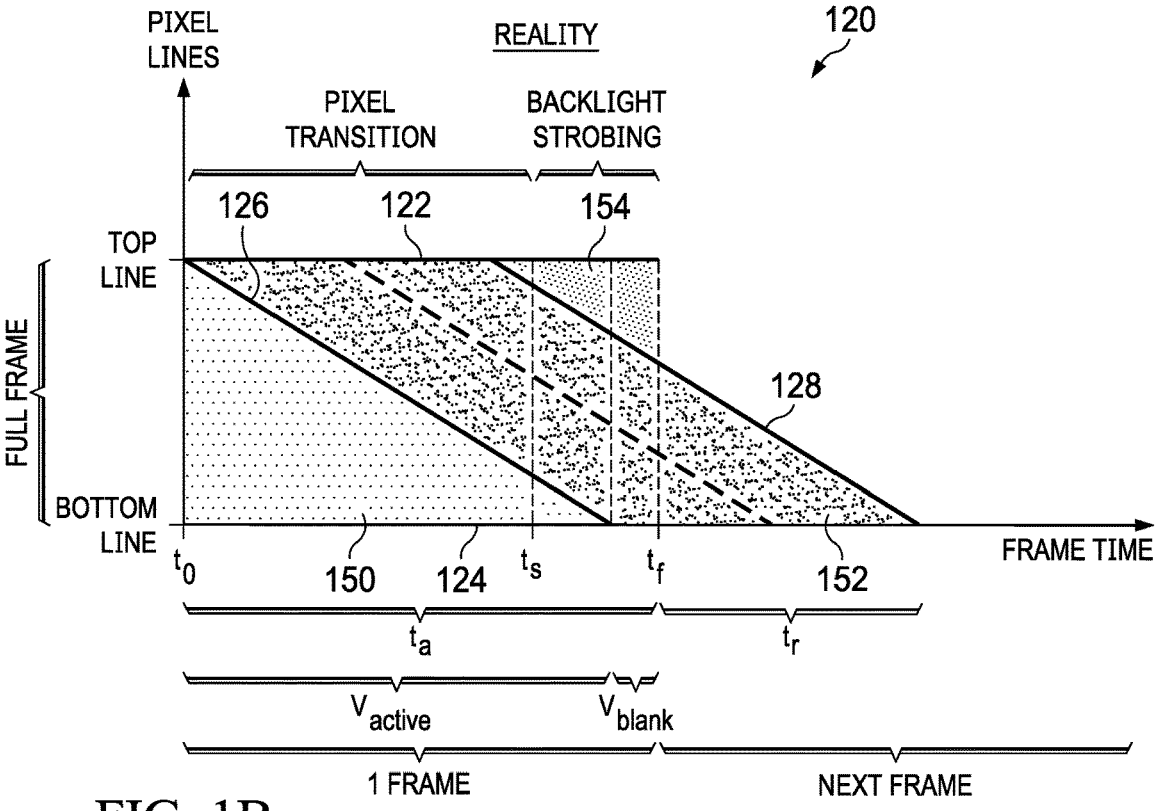

FIGS. 1A and 1B illustrate an ideal progressive frame refresh sequence 100 and an actual progressive frame refresh sequence 120 that occurs in an edge-lit LCD display according to one embodiment of the present disclosure. In general, the ideal progressive frame refresh sequence 100 and an actual progressive frame refresh sequence 120 represent actions that are performed with each frame generated by the LCD display. The progressive scan sequences represent progressive scanning in which all the pixel lines of each frame are drawn in sequence from the top line 102, 122 to the bottom pixel line 104, 124 of the LCD screen. The diagonal lines 106, 126 and 108, 128 represent a progressive scan sequence as all of the pixel lines are sequentially refreshed on the LCD display.

Time $t_a$ refers to an active time in which the pixel lines are being refreshed, time $t_r$ refers to a response time for the individual pixels in each pixel line to be refreshed, $t_r$ indicates a point indicates a point that is the current frame end, while $t_s$ indicates a starting point at which a backlight strobe begins to generate light through each of the pixel lines. Within the ideal progressive scan sequence 100 and actual progressive scan sequence 120, regions 140 and 150 represent a time before the pixels begin their transition to the new values, regions 142 and 152 represent a duration of time that the pixels are in the process of transitioning to the new values, while regions 146 and 154 represent a time after the pixels have been transitioned to the new values. That is, not all pixel lines can complete the transition in the current frame, and thus, some pixel lines continue transition in the next frame.

As shown in the ideal progressive scan sequence 100, all pixel lines have finished transitioning to the new frame level before the backlight strobe is turned on. As shown, point 112 represents completion of frame refresh of all pixel lines before the backlight strobe is turned on. In reality, however, most LCD displays function like the actual frame refresh sequence 120 of FIG. 1 B. That is, backlight strobing commences before the bottom pixel line 124 completes its transition, which is usually performed to generate sufficient luminance for the display. That is, in every frame, the pixel lines start pixel transitioning progressively from top line to bottom line. Ideally, backlight strobing will start in Vblank period and after all pixel lines' pixel transition to completion. But in reality, due to slow LCD pixel response and small Vblank/Vactive ratio, which may be limited by bandwidth, the backlight strobing often has to be turned on during the Vactive period even though all of the pixel lines' pixel transition has not run to completion.

Conventional LCD implementations have involved a trade-off of sacrificing the visual performance of pixel lines proximate the top and bottom of the screen to optimize performance at the center region of the screen. That is, most commercially available edge-lit display products' MPRT use a strobing backlight that turns on without waiting for all the pixels to complete the update process, leading to image quality deterioration across the full screen. Some conventional LCD implementations have involved scanning backlights to solve full screen range motion blur reduction, through either symmetric left-right (e.g., 2×) edge-lit light bar, direct-lit, or mini-LED backlight systems. However, these scanning backlight systems introduce more complexity in product development, thus yielding higher product cost. Furthermore, symmetric left-right edge-lit backlight systems unavoidably increase the bezel thickness on both the left and right edge of the display, while direct-lit backlight systems increase the LCD display's thickness. Hence, scanning backlights are undesirable for the modern slim, narrow bezel, and cost sensitive LCD devices. As such, there has heretofore remained a pressing need in edge-lit LCD systems to reduce or eliminate the MPRT's full screen range motion blur problem and improve the user experience by obtaining the full benefit of the MPRT architecture.

As will be described in detail herein below, embodiments of the present disclosure provide a solution to this problem by introducing progressively different overdrive levels for the pixel lines of an LCD display to achieve an overall fast response time and less motion blur across the entire screen, rather than just emphasizing image quality in center region of the screen. Additionally, a novel response time compensation (RTC) system using a grey level value derived at the end of the current frame as input for the frame buffer to generate more accurate liquid crystal transition position prediction for precise liquid crystal's response control. The RTC system also leverages the widely recognized International Commission on Illumination (CIE) standard (e.g., CIEDE2000) to evaluate MPRT system with objective quantitative measures on HVS's image motion artifacts.

For purposes of this disclosure, an Information Handling System (IHS) may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an IHS may be a personal computer (e.g., desktop or laptop), tablet computer, mobile device (e.g., Personal Digital Assistant (PDA) or smart phone), server (e.g., blade server or rack server), a network storage device, or any other suitable device and may vary in size, shape, performance, functionality, and price. An IHS may include Random Access Memory (RAM), one or more processing resources such as a Central Processing Unit (CPU) or hardware or software control logic, Read-Only Memory (ROM), and/or other types of nonvolatile memory.

Additional components of an IHS may include one or more disk drives, one or more network ports for communicating with external devices as well as various I/O devices, such as a keyboard, a mouse, touchscreen, and/or a video display. An IHS may also include one or more buses operable to transmit communications between the various hardware components.

Figure 2:
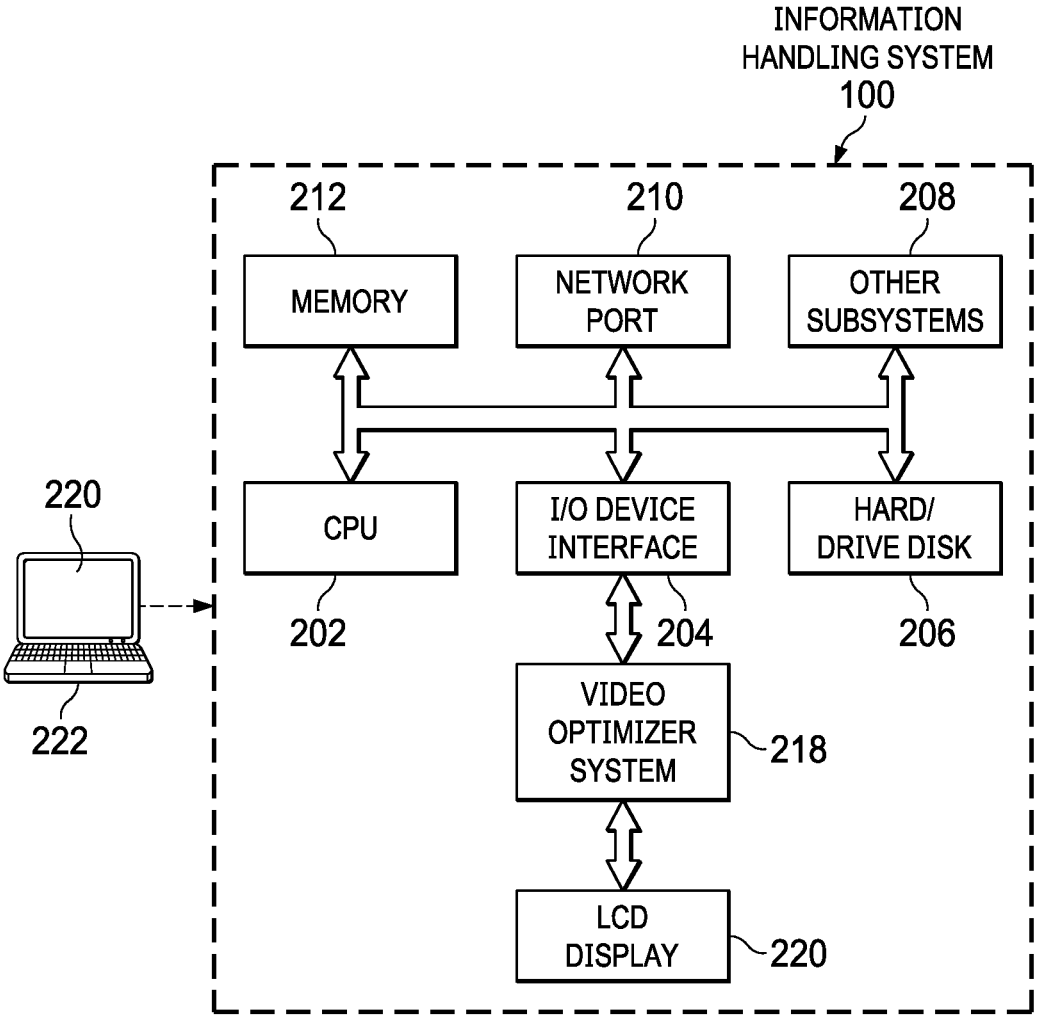
FIG. 2 illustrates a block diagram of example components of an Information Handling System (IHS) configured to implement a Response Time Compensation (RTC) system for progressive scan LCD displays according to one embodiment of the present disclosure.

FIG. 2 illustrates a block diagram of example components of an Information Handling System (IHS) configured to implement a Response Time Compensation (RTC) system for progressive scan LCD displays according to one embodiment of the present disclosure. As shown, IHS 200 includes a plurality of processing components, including LCD panel 220 disposed in a housing 222. In various implementations, video artifacts related to "smearing" or "ghosting" of motion video as displayed on LCD panel 220 can be mitigated while reducing the number of computational cycles and graphics controller power overhead.

Components of IHS 200 may include, but are not limited to, processor 202 (e.g., central processor unit or "CPU"), input/output (I/O) device interface 204, such as a display, a keyboard, a mouse, and associated controllers, hard drive or disk storage 206, various other subsystems 208, network port 210, and system memory 212. Data is transferred between the various system components via various data buses illustrated generally by bus 214. Video optimizer system 218 couples I/O device interface 204 to LCD display panel 220, as described in more detail below.

In some implementations, IHS 200 may not include each of the components shown in FIG. 2. In other implementations, IHS 200 may include other components in addition to those that are shown in FIG. 2. Furthermore, some components that are represented as separate components in FIG. 2 may instead be integrated with other components. For example, all or a portion of the functionality provided by two or more discrete components may instead be provided by components that are integrated into processor(s) 202 (e.g., CPU) as a systems-on-a-chip.

Figure 3A:
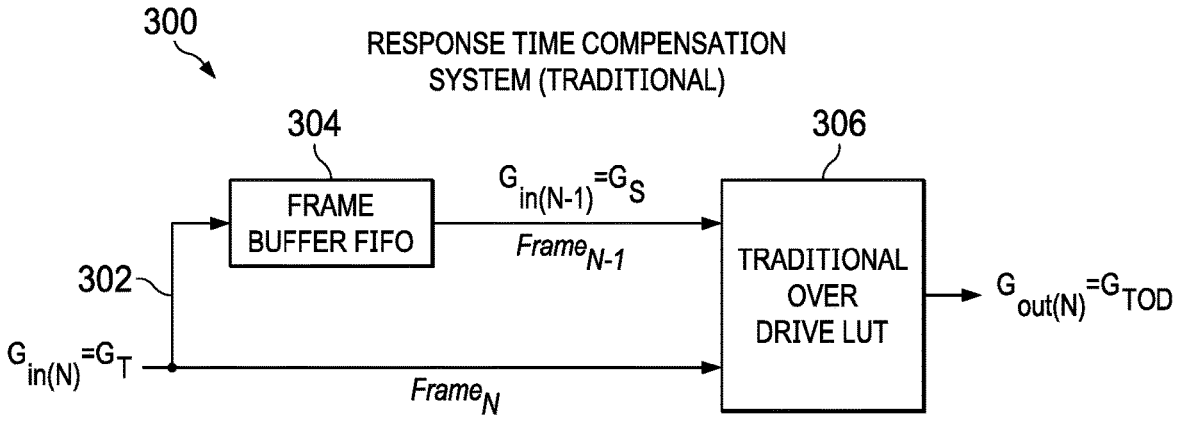
FIGS. 3A and 3B are block diagram illustrations of conventional and new Response Time Compensation (RTC) systems, respectively, according to one embodiment of the present disclosure.
Figure 3B:
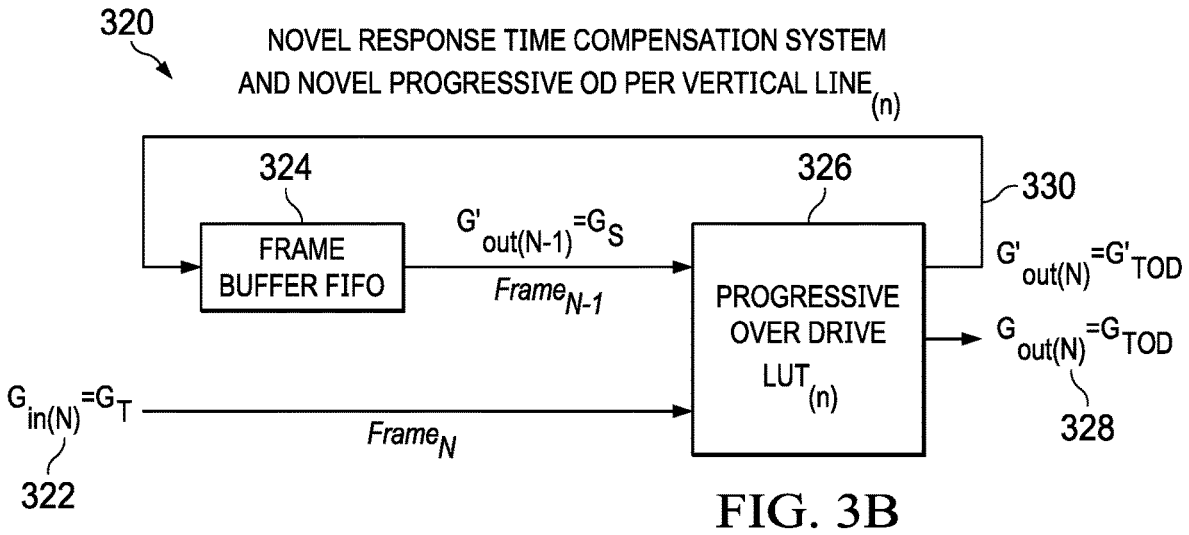

FIGS. 3A and 3B are block diagram illustrations of conventional and new Response Time Compensation (RTC) systems, respectively, according to one embodiment of the present disclosure. In the conventional RTC system 300, the previous frame-end grey-level ($G'_{TOD}$) information 302 is inputted into the RTC frame buffer 304, and it is with the information 302 that is used as input to the look-up table (LUT) 306. In the new RTC system 300, however, it is implemented with frame buffer 324 and look-up table (LUT) 326. A novel RTC architecture is introduced by storing the current frame-end grey-level ($G'_{TOD}$) information 330 into the RTC frame buffer 324. Thus, the current frame-end grey-level ($G'_{TOD}$) information 330 is compared with an incoming grey level information (Gin) 322 such that a predetermined alternate grey level is chosen from look-up table (LUT) 326. The chosen grey level value is then issued as outgoing grey level information ($G_{out}$) 328, which can be used for response compensation. The compensation can result in either over-driven or under-driven voltages being applied. Such an RTC architecture differs from conventionally implemented techniques in which the Last Frame's input grey-level ($G_{(n-1)}$) is compared with an incoming grey level command ($G_{in}$) 322 to determine an alternate grey level that is chosen from the look-up table (LUT) 326.

$$L(G'_{TOD(n)})=GLRC_{G_S\rightarrow G_{TOD(n)}}(t)|_{t=1/Framerate} \quad \text{Equation 1}$$

Where: L(G) is the luminance of grey-level G; $G'_{TOD(n)}$ is the grey-level at one frame period of time, per overdriven LUT for the $n^{th}$ pixel line ($1\leq n\leq V_{active}$, for example, FHD, $1\leq n\leq 1080$); $GLRC_{G_S\rightarrow G_{TOD(n)}}$ is the native grey-level response curve from starting grey-level to the overdrive grey-level $G_{TOD(n)}$ (based on OD LUT for $n^{th}$ line).

It may be important to note that the actual liquid crystal normally will not transit to the overdriven grey-level $G_{TOD(n)}$ at the end of the frame (e.g., 16.7 ms for 60 Hz, or 6 ms for 165 Hz) due to relatively slow native response times (e.g., approximately 10 milliseconds.), the $G_{TOD(n)}$ will be the end-of-frame value and LC will be refreshed on every frame basis. The delta between $G_{TOD(n)}$ and $G_{Target}$ is where the artifact that the human vision system (HVS) captures.

Figure 4:
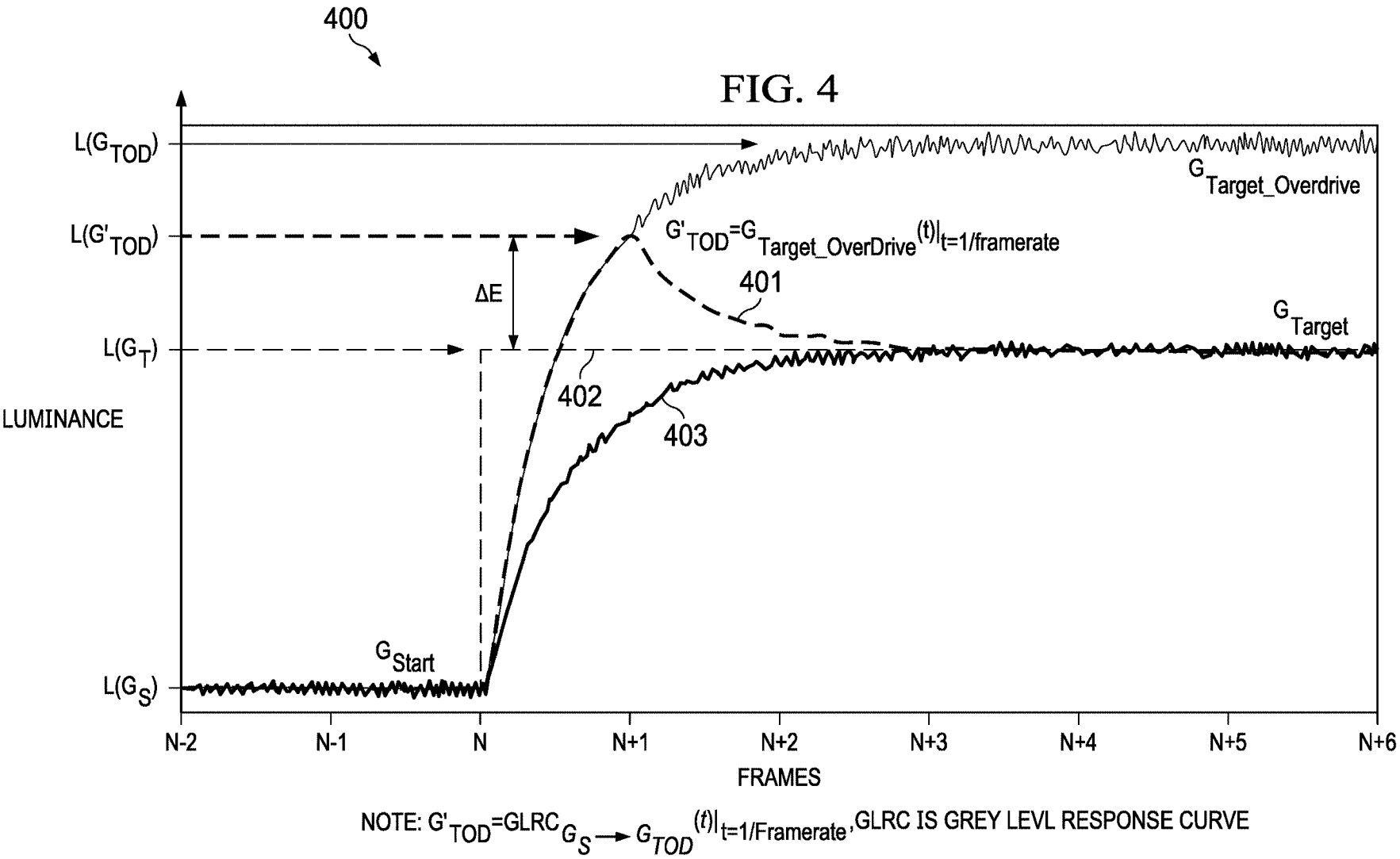
FIG. 4 shows a graph of an example overdriven grey level response curve (GLRC), according to one embodiment of the present disclosure.

FIG. 4 shows graph 400 of an example overdriven grey level response curve (GLRC), according to one embodiment of the present disclosure. As a characteristic of a HVS, brightness stimulus is the temporal integration for most Smooth Pursuit Eye Movements (SPEM), such as objective tracking in FPS games.

In FIG. 4, $G_{Start}(G_S)$ is the starting initial grey level, $G_{Target}(G_T)$ is the ending target grey level, $L(G_S)$ is luminance of $G_S$ grey level and $G_{Overdrive_Target}(G_{ODT})$ is the selected OD grey level. An overdriven grey level transition from $G_{Start}(G_S)$ to $G_{Target}(G_T)$, shown as curve 401, is made of 2 segments: the first frame (from N to N+1) follows the native GLRC from $G_{Start}(G_S)$ to $G_{Overdrive_Target}(G_{ODT})$, and the rest frames(from N+1 onward) follow another native GLRC from $G'_{Overdrive_Target}(G'_{ODT})$ to $G_{Target}(G_T)$, where: $G'_{Overdrive_Target}(G'_{ODT})$ is the equivalent Grey level at $1^{st}$ frame-end of GLRC from $G_S$ to $G_{ODT}$, defined below:

$$L(G'_{ODT})=GLRC_{G_S\rightarrow G_{ODT}}(t)=_{t=1/Framerate} \quad \text{Equation 2}$$

Thus, the over-driven GLRC 401 may be given by:

$$OD_{G_S\rightarrow G_T}(t)=\begin{cases} GLRC_{G_S\rightarrow G_{ODT}}(t), & 0\le t\le 1/Framerate \\ GLRC_{G'_{ODT}\rightarrow G_T}(t), & \wedge t\ge 1/Framerate \end{cases} \quad \text{Equation 3}$$

As seen in FIG. 3, overdrive can introduce overshoot/undershoot lasting for several frames (up to 3~4 frames per today's panel technology), which is also a temporal luminance stimulus integration on observer's HVS. Stronger overdrive leads to additional higher/lower luminance in the period of overshoot/undershoot, and those temporal integrations on the HVS causes inverse ghosting artifact on vision perception. Conversely, a weak/zero overdrive does not allow the observer's HVS to receive enough luminance in the period of pixel transition and therefore causes motion blur/tailing feeling. In an ideal case, a HVS would receive the exact luminance of the "N+1" frame with infinite small (i.e., "0") response time, shown as curve 402.

To minimize artifacts, it becomes necessary to control the total temporal luminance stimulus received on observers' HVS to be equivalent as the luminance integrated by the ideal grey level transition. Moreover, due to the difference between individual HVSs, an error/offset margin (ΔE) may be introduced, shown as curve 403, to further improve the response time.

Figure 5A:
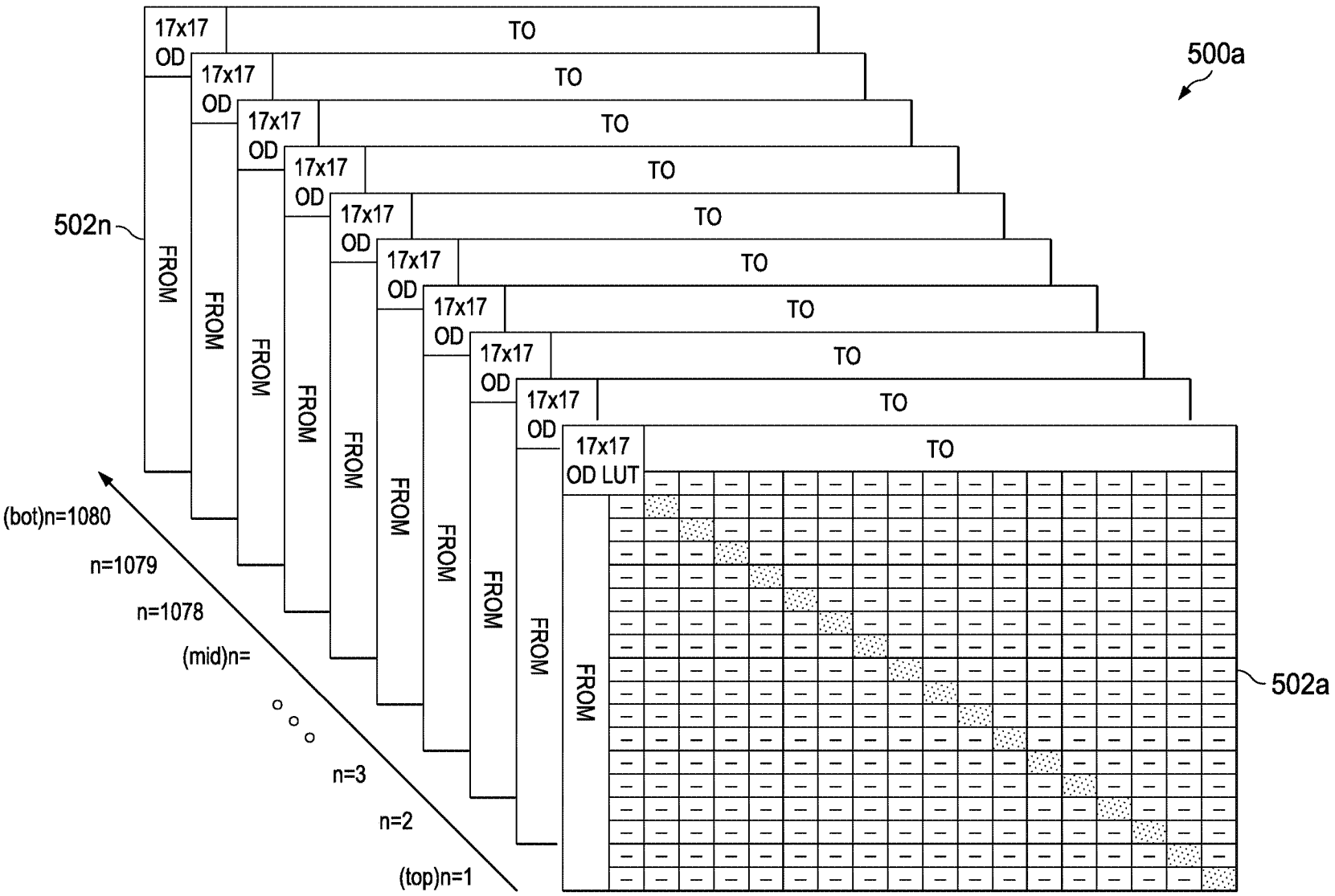

FIGS. 5A and 5B illustrate an example group of multiple overdrive (OD) LUTs 500 that may be used to progressively increase the overdrive (OD) response strength according to one embodiment of the present disclosure. The multiple OD LUTs are configured to progressively increase an observer's HVS from the top pixel line (n=1) to the bottom pixel line (n=1080) of an LCD. In particular, FIG. 5A depicts multiple LUTs 502*a-n* that may be generated for each pixel line of the LCD. Although the present embodiment is shown and described as having 1080 LUTs corresponding to an LCD having 1080 pixel lines, it should be appreciated that the group of LUTs 500*a-n* may be adapted for use with other LCDs having any quantity of pixel lines, such as more than 1080 pixel lines, or less than 1080 pixel lines.

Additionally, although the present embodiment is described as having one OD LUT 502*a-n* for each pixel line of the LCD, it should be appreciated that in other embodiments, the system may generate a quantity of the LUTs that is less than the quantity of pixel lines of the video stream, such that the resulting grey levels for each pixel line is accomplished by interpolating between the alternate grey levels of two of the OD LUTs 502*a-n*. For example, if LUTs are generated for every tenth pixel line (e.g., n=1 pixel line LUT, n=10 pixel line LUT, and so on), the values for the fifth pixel line may be calculated by averaging the luminance values of the LUTs associated with the first and tenth pixel lines.

FIG. 5B illustrates several details associated with each OD LUT 502*a-n* of FIG. 5A according to one embodiment of the present disclosure. In this 17×7 LUT, 17 "from" grey levels 0-255 (vertical) are mapped to 17 "to" grey levels 0-255 (horizontal). Each column/row intersection contains, for a particular "from/to" combination, a predetermined OD grey level. For example, if the initial grey level is 176 and the target grey level is 208, the OD grey level value is set to 216 to provide an overshooting boost or compensation. Conversely, if the initial grey level is 96 and the target grey level is 48, the OD grey level value is set to 33 to provide an undershooting boost or compensation.

Figure 6:
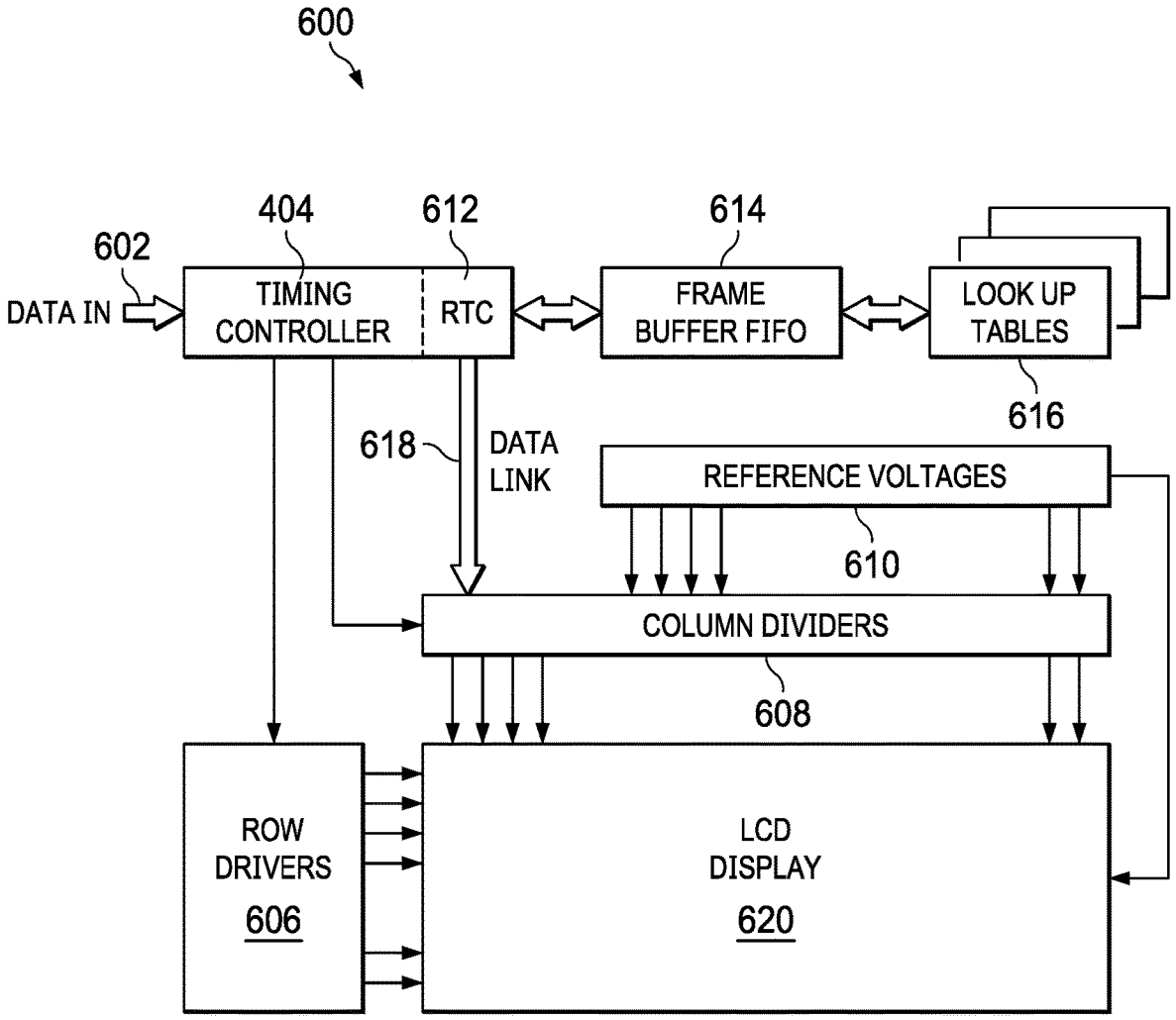
FIG. 6 is a block diagram illustration of an embodiment of a Response Time Compensation (RTC) system according to one embodiment of the present disclosure.

FIG. 6 is a block diagram illustration of an embodiment of a Response Time Compensation (RTC) system 612 according to one embodiment of the present disclosure. The system 612 as generally implemented includes a timing controller 604, a FIFO frame buffer 614, and a LCD display 620. The LCD display 620 comprises row drivers 606 and column drivers 608. Reference voltages 610 are supplied to column drivers 608 and LCD display 620 in a resistive-string, digital-to-analog converter (RDAC), column-driven architecture.

The timing controller 604 is coupled to row drivers 606 and column drivers 608, which map grey level values to voltage nodes on a series resistance string. The column drivers 608 predetermine the voltage needed at each node to achieve the associated brightness level required to produce the intended grey level value. As grey level commands in digital video stream data 602 are received by the timing controller 604, the RTC logic 612 retrieves the previous grey level to the corresponding element within the video data stream from the FIFO frame buffer 614.

Simultaneously, the RTC logic 612 stores the current grey level in FIFO frame buffer 614 for use in the next frame. The RTC logic 612 then compares the current and previous grey level commands for each separate red, green and blue (RGB) element using separate RGB look-up tables 616. The contents of RGB look-up tables 616 provide a unique grey level surrogate for each pairing of current and previous grey level commands, which is used to calculate the value of grey level substituted boost 308.

Grey level substituted boost commands are communicated by the RTC logic 612 through a data link 618 to column drivers 608, which then produce an override, or "over-drive" command to deliver appropriate higher voltage to the voltage node. Delivering the higher voltage results in compensated response, thereby reducing video artifacts that can contribute to smearing of video images containing motion.

In other embodiments, RTC 612, Frame Buffer FIFO 614, and Look-Up Tables 616 may all be implemented within a scalar processor, which may be disposed inside or outside of the LCD display 620. In those cases, the data input into timing controller 604 may be RTC-processed. That is, the scalar processor may complete the RTC and then pass processed data to timing controller 604 for LCD display 620 to render.

In various embodiments, systems and methods described herein may employed to: capture an LCD panel's native response time and its overdrive response time, and to auto-generate an overdrive LUT based on those measurements. For example, a hardware system may include a grey level photo sensor, test IHS, and a display. A method used to generate an overdrive LUT may be based on a HVS's vision perception, luminance temporal integration, and just-noticeable difference (JND) (e.g., derived from CIEDE2000). Particularly, such a method may control the total temporal luminance stimulus received on observer's HVS to be equivalent as the luminance integrated by ideal grey level transition with an error/offset range of JND ($\Delta E_{00}$).

Figure 7:
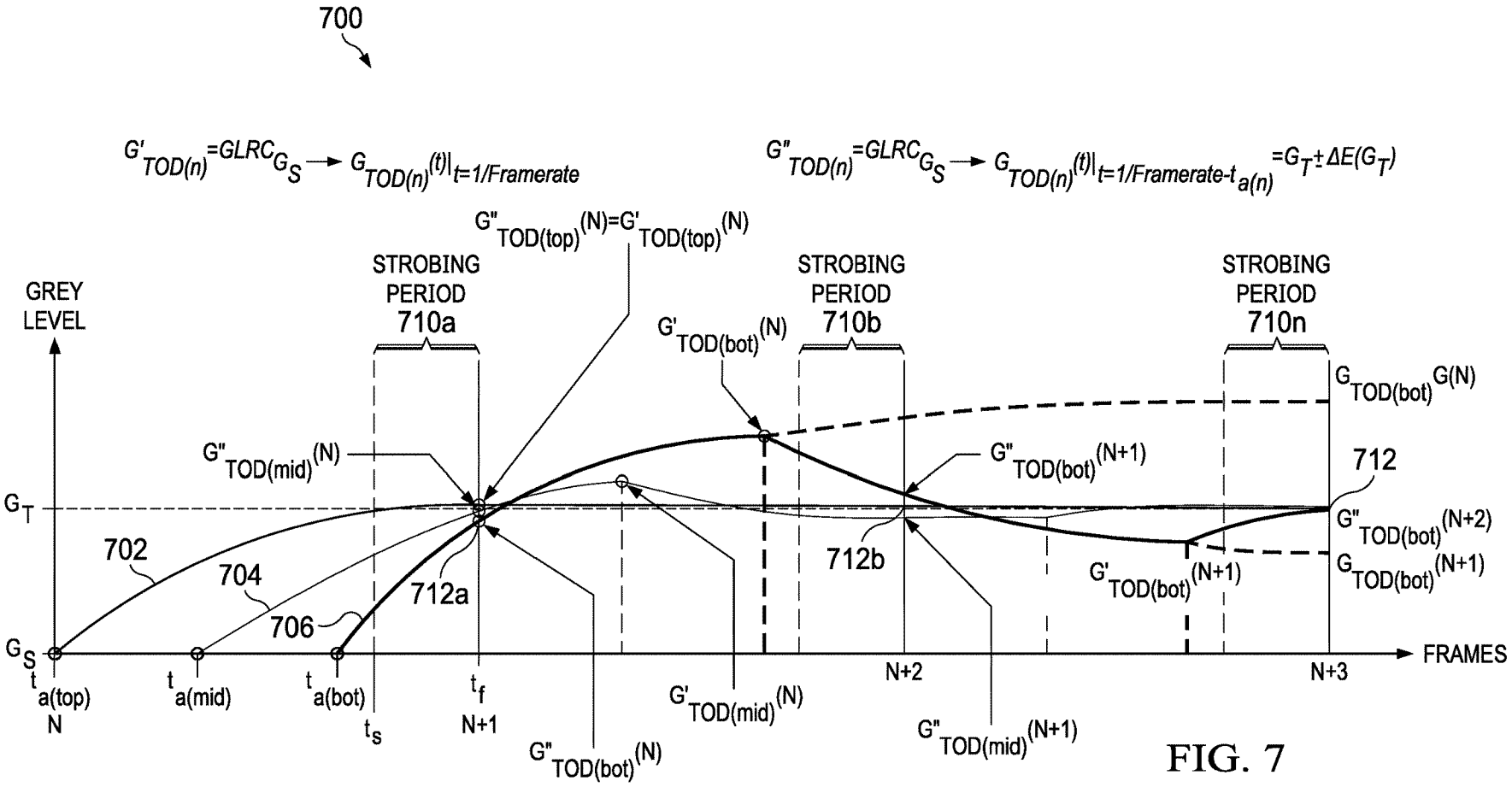
FIG. 7 illustrates an example progressive OD graph that may be used for simultaneous backlight strobing according to one embodiment of the present disclosure.

FIG. 7 illustrates an example progressive OD graph 700 that may be used for simultaneous backlight strobing according to one embodiment of the present disclosure. The progressive OD graph 700 depicts an average luminance intensity 702 that may be imparted on the pixel lines proximate the top of the LCD screen, an average luminance intensity 704 that may be imparted on the pixel lines proximate the middle of the LCD screen, and an average luminance intensity 706 that may be imparted on the pixel lines proximate the bottom of the LCD screen using the progressive OD LUTs 502*a-n* of FIGS. 5A and 5B. Time $t_{a(top)}$ indicates the beginning of an active period for updating the top pixel line 702, Time $t_{a(mid)}$ indicates the beginning of an active period for updating the middle pixel line 704, and Time $t_{a(bot)}$ indicates the beginning of an active period for updating the bottom pixel line 706 for each frame generated by the LCD. Additionally, regions 710*a-n* indicate a strobing time period ($t_s$ to $t_s$) in which the backlight is illuminated onto each of the pixel lines 502*a-n*.

In general, the progressive OD LUTs 502*a-n* corresponding to the pixel line 704 proximate the middle of the LCD screen is configured to generate an increased luminance intensity relative to the OD LUT 502*a-n* corresponding to pixel line 702. Additionally, the progressive OD LUTs 502*a-n* corresponding to the pixel line 706 proximate the bottom of the LCD screen is configured to generate an increased luminous intensity relative to the OD LUT 502*a-n* corresponding to pixel line 704. Thus, each of the generated LUTs can be considered to generate a luminance on its respective pixel line that progressively increases from the top pixel line 502*a* to the bottom pixel line 502*n* of the LCD.

In one embodiment, the progressive OD LUT for each pixel line is configured to have an OD level such that such that each of the LUTs generates at least partially the same level of luminance at the end of a strobe period of the LCD as indicated at points 712*a-n*. That is, the pixel lines 502*a-n* toward the bottom of the LCD screen are driven at a progressively harder level so that their luminous intensity is generally similar to that of the pixel lines 502*a-n* proximate the top of the LCD screen.

The multiple LUTs may be generated based on equation 4.

$$L(G''_{TOD(n)})=GLRC_{G_S\rightarrow G_{TOD(n)}}(t)|_{t=1/Framerate-t_{a(n)}}= L(G_T+\Delta E(G_T)) \quad \text{Equation 4}$$

Where is the grey-level at physical frame-end, or end of strobing backlight time stamp as indicated at points 712*a-n*. It may be important to note that the first top line pixels duration time is much longer than the last bottom line pixels due to the inherent nature of the progressive LCD panel mechanism that begins strobing before the bottom pixel line has finished updating. Nevertheless, every pixel will still be refreshed on every frame period of LCD screen.

In Equation 2, the duration time of the nth line at end of strobing may be set to, where is data addressing time of the pixel line 502*n*. This can mean that at the time the specific nth horizontal pixel line is addressed to start at the transition phase, as defined by Equation 5:

$$t_{a(n)} = \frac{1}{\frac{Framerate}{V_{active}+V_{blank}}} * (n-1),\ 1 \le n \le V_{active} \quad \text{Equation 5}$$

Here, the strobing time $t_s$ is defined as the starting time of strobing backlight in each frame, while $t_r$ is referred to the response time that each lines' pixel will take, once being addressed, to complete the transition to its target grey-level. Also, the delta Grey-level may be based on selection(e.g.,=0, 1, 2, 3, etc.) for that particular grey-level, which will be described in detail herein below.

Thus, after the native Grey Level Response Curve across each grey-to-grey response is captured and recorded in the native GLRC raw database, based on Equation 2, for every frame, the framerate only needs to be deduced from Equation 2 to form a progressive OD LUT per line(n), as shown in FIG. 7. In some embodiments, the progressive OD LUTs can be stored in as little as 2 or 3 LUTs with interpolation for different LUT(n) in order to save memory usage as described herein above.

Thus, by introducing the progressive overdrive as described above for different pixel lines (the OD response strength is progressively increased from weak for the top pixel line too strong for the bottom pixel line), some, most, or all pixel lines will be able to transit to the target grey level $G_{Target}$ at the moment when the backlight is turned on.

Of all the pixel lines, the first top horizontal line's pixels will have the longest response reaction duration with the least amount of overdrive strength. Assuming the time taken for the pixel to change from the starting gray level ($G_{Start}$) to the target gray level ($G_{Target}$) is equal to the strobing time $t_s$, as illustrated by the blue curve, the top pixel line 702 could have no overshoot OD strength and will use the whole time to complete its transition before strobing backlight is turned on. For the middle pixel line 704, the remaining time for it to complete transition before $t_s$ is shortened by the data addressing time consumption, thus the middle pixel line 704 will require some amount of overshoot overdrive to increase its transition process. Similarly, the bottom pixel line 706 will have the least time for it to finish transition and will hence have the strongest overshoot overdrive as illustrated by the green curve.

Because of the different overdriven strength applied, all frame line is able to transit to the target grey level during backlight strobing, thus, full screen range clearance is accomplished. The pixels of the middle pixel line 704, and those of the bottom pixel line 706 may continue the transition journey if response time $t_r$ (from $G_{Start}$ to) is longer than 1/Framerate, but since back light strobing is turned off at points 712*a-n*, the inverse ghosting artifacts by being overdriven will not be noticed by user due to strobing backlight being off during those periods.

Figure 8:
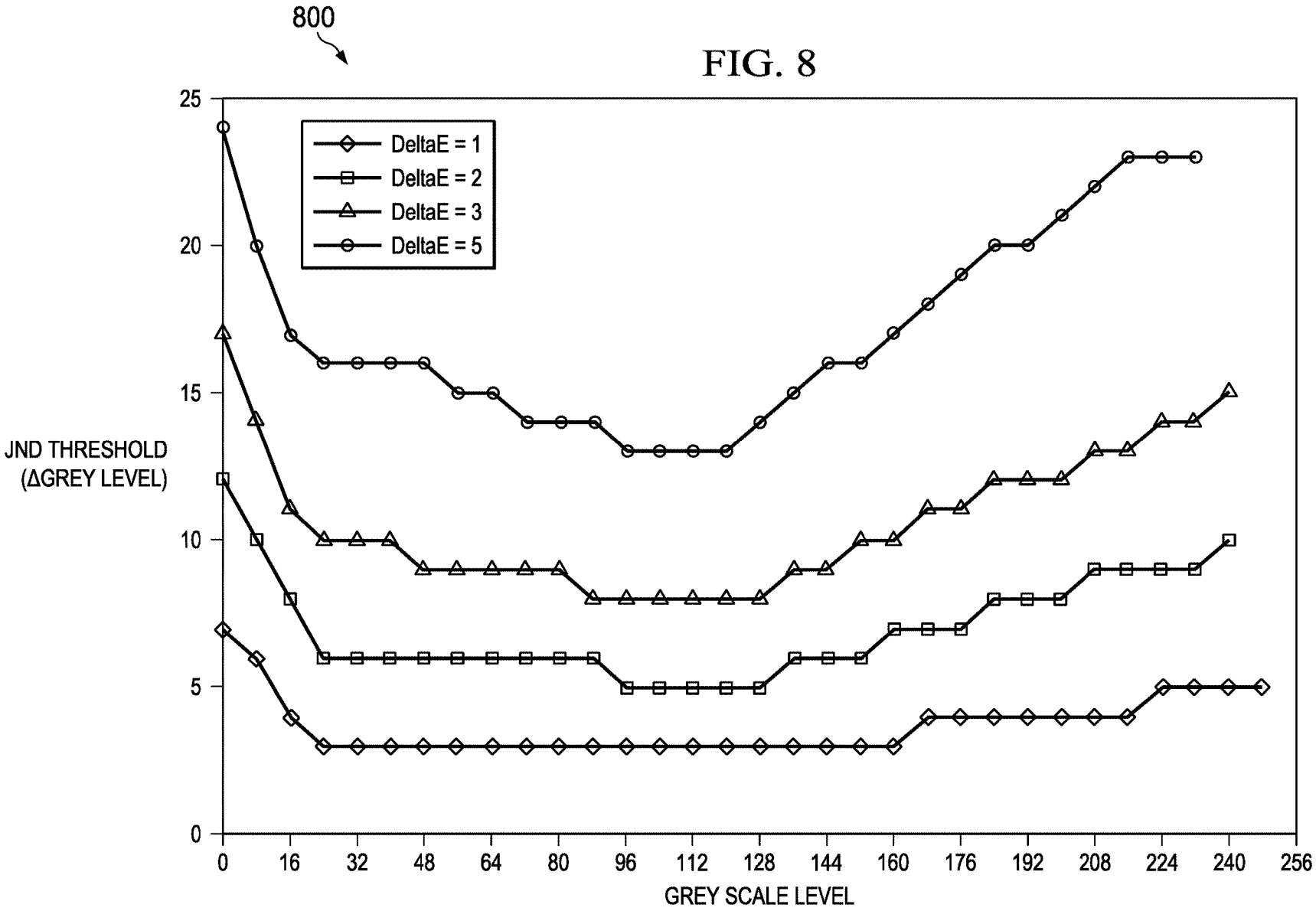
FIG. 8 illustrates an example graph of several grey level just-noticeable difference (JND) thresholds according to one embodiment of the present disclosure.

FIG. 8 illustrates an example graph 800 of several grey level just-noticeable difference (JND) thresholds according to one embodiment of the present disclosure. According to embodiments of the present disclosure, the RTC progressive OD LUT algorithm may use the JND thresholds to compensate the visual unnoticeable margin for faster response, especially for the pixel lines proximate the bottom of the LCD screen. In this technique, color differences may be quantified using ΔE to simulate different Human Vision System's (HVS's) JND. It is noted that for different grey levels, the HVS has different tolerance JND thresholds under same ΔE. Additionally, the JND threshold level can be expressed in the format of delta grey-level ΔG. Thus, for each different grey level (GL), the JND threshold can be described as a delta grey-level ΔG in the function of ΔE, shown as below:

$$JND_{GL}=\Delta G_{GL} \quad \text{Equation 6}$$

Thus, by introducing a certain amount of visual unnoticeable error based on DeltaE, it can help to weaken the OD strength for those relatively slow native response time LCD displays, especially at the bottom-line range, and to settle the pixels transition faster within some frames.

Figure 9:
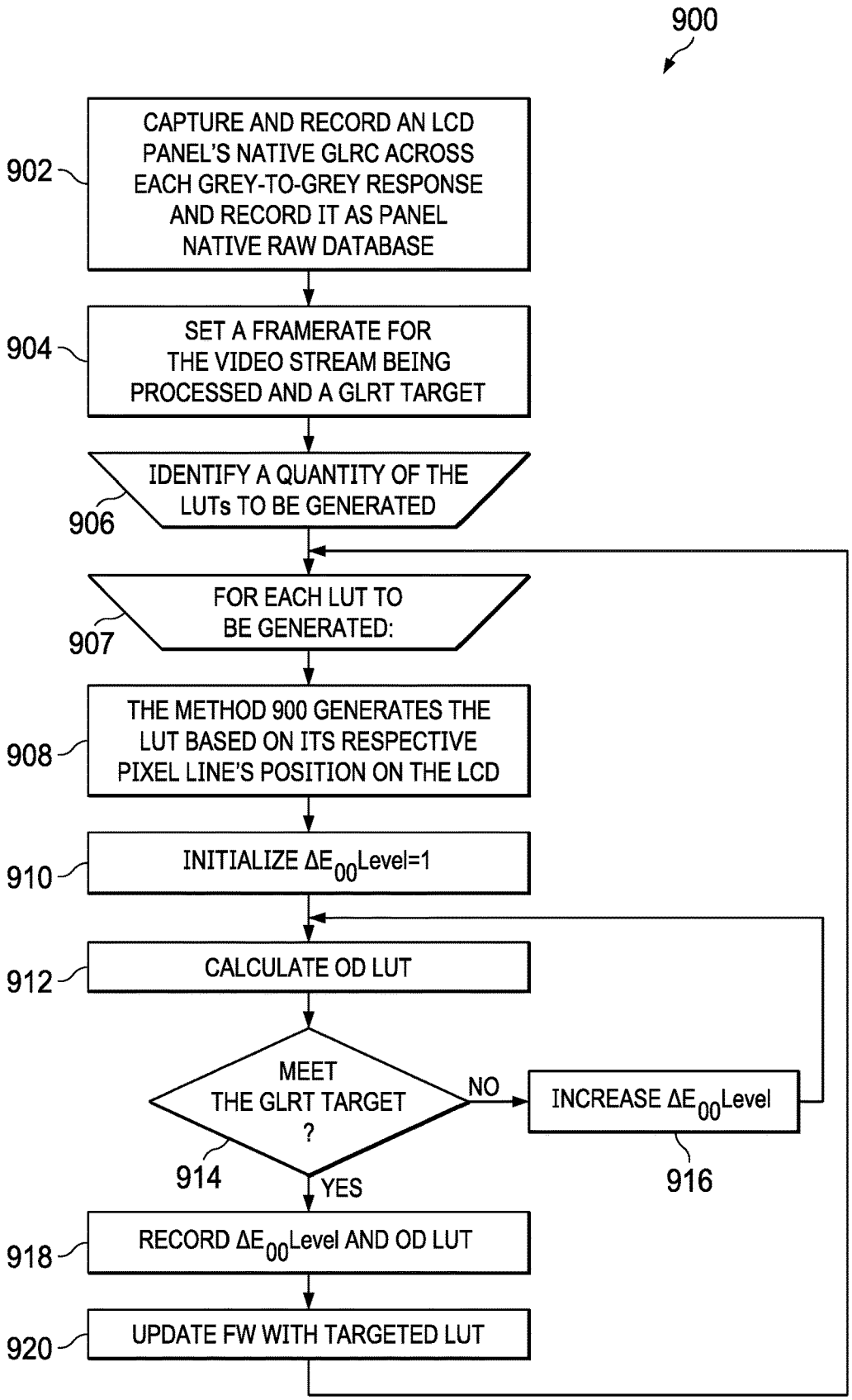
FIG. 9 is an example method for generating multiple overdrive LUTs that may be used for providing response time compensation (RTC) of a display device according to one embodiment of the present disclosure.

FIG. 9 is an example method 900 for generating multiple overdrive LUTs that may be used for providing response time compensation (RTC) of a display device according to one embodiment of the present disclosure. In one embodiment, the method 900 operates in three stages. First, the method 900 captures an LCD panel's native GLRC. Second, the method 900 calculates the OD LUT. Third, method 900 may optionally measure GLRT to verify it and/or to generate a report.

At step 902, the method 900 captures and records a LCD panel's native GLRC across each grey-to-grey response and records it as panel native raw database. The GLRC may be stored in the format of multiple greyscale matrices (e.g., LUTs) which full matrix size depends on color bit-depth, e.g., 255×255 for an 8-bit panel as full matrix. Due to a non-linear liquid crystal temporal response, the larger the matrix size recorded the better the OD LUT optimization. In some cases, to balance capturing process time and accuracy, an interpolation may be used. For example, a 65×65 measured matrix with interpolation may be used to predict the full 255×255 GLRC matrix for an 8-bit panel. Thereafter at step 904, the method 900 sets a framerate for the video stream being processed, and a GLRT target (e.g., 144 Hz, 1 ms).

At step 906, the method identifies a quantity of the LUTs 502*a-n* to be generated. In one embodiment, the quantity of LUTs may be equivalent to the quantity of pixel lines on the LCD. In another embodiment, the quantity of LUTs may be a subset of the total quantity of pixel lines on the LCD. For example, if the LCD has 1080 horizontal pixel lines, the method 900 may set the quantity at 108 LUTs such that a LUT is generated for every 10 pixel lines on the LCD. In another embodiment, the method 900 may set the quantity based on certain characteristics of the IHS 200, such as an amount of available memory for storing the LUTs, an available amount of processing capabilities, and/or a desired level performance of the LCD.

In general, steps 908 through 920 describe actions that are performed by the method 900 for each LUT to be generated as shown at step 907.

At step 908, the method 900 generates the LUT based on its respective pixel line's position on the LCD. For example, the method 900 may calculate a luminance for each grey scale and an equivalent grey level at first frame end for each grey-to-grey transition based upon its pixel line's position (e.g., n=1 to 1080). In one embodiment, the method 900 calculates the luminance to be increased as the pixel line's position is proximate the bottom portion of the LCD screen. In a particular example, the method 900 may calculate the luminance for each grey scale according to Equation 2(ID) shown above. Additionally, the method 900 may calculate luminance based upon a duration of the n'th pixel line at the end of the strobing period according to Equation 3(ID) shown above.

At step 910, the method 900 initializes $\Delta E_{00}$ to a "1" value. At step 912, the method 900 may calculate the OD LUT, for example, using equations 2 and 3(ID) above. At step 914, the method 900 determines whether the GLRT target is met. If not, step 916 increases or increments the $\Delta E_{00}$ level (e.g., $\Delta E_{00}$="2," and so on) and control returns to step 912. Otherwise, at step 918, the method 900 records the current $\Delta E_{00}$ level and the current OD LUT. Because the framerate and all GLRC values are known, for each, the only variables are $G_{ODT}$ and, so method 900 may auto-calculate the suitable $G_{ODT}$ to meet target response time $\tau_{OD(G_S \rightarrow G_T)}$ by starting from lowest E to minimize the artifact. Thereafter at step 920, the method 900 may update the display's firmware with the targeted LUT.

The process as described by steps 908 to 920 is performed for each OD LUT generated by the method 900. Nevertheless, when use of the method 900 is no longer needed or desired, the method 900 ends.

It should be understood that various operations described herein may be implemented in software executed by processing circuitry, hardware, or a combination thereof. The order in which each operation of a given method is performed may be changed, and various operations may be added, reordered, combined, omitted, modified, etc. It is intended that the invention(s) described herein embrace all such modifications and changes and, accordingly, the above description should be regarded in an illustrative rather than a restrictive sense.

The terms "tangible" and "non-transitory," as used herein, are intended to describe a computer-readable storage medium (or "memory") excluding propagating electromagnetic signals; but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including, for example, RAM. Program instructions and data stored on a tangible computer-accessible storage medium in non-transitory form may afterwards be transmitted by transmission media or signals such as electrical, electromagnetic, or digital signals, which may be conveyed via a communication medium such as a network and/or a wireless link.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. An Information Handling System (IHS), comprising:
a controller; and
a memory coupled to the controller, the memory having program instructions stored thereon that, upon execution, cause the controller to:
generate a plurality of Look-up Tables (LUTs), wherein each LUT comprises alternate grey levels selected to implement Response Time Compensation (RTC) in a Liquid Crystal Display (LCD), and wherein the alternate grey levels are determined, at least in part, based upon a pixel line of a video stream; and
at least one of:
(a) in response to a result produced by a given LUT that meets a selected grey level response target (GLRT), record the given LUT; or
(b) in response to a result produced by a given LUT that does not meet a selected GLRT, increment the offset margin value and recalculate the given LUT using the incremented offset margin value.

2. The IHS of claim 1, wherein the program instructions, upon execution, further cause the controller to, for each LUT, calculate the alternate grey levels corresponding to a position of the pixel line on the LCD.

3. The IHS of claim 2, wherein each of the LUTs is configured to generate a luminance on its respective pixel line that progressively increases from a top pixel line to a bottom pixel line of the LCD.

4. The IHS of claim 1, wherein the program instructions, upon execution, further cause the controller to, for each LUT, calculate the alternate grey levels such that each of the LUTs generates the same level of luminance at the end of a strobe period of the LCD.

5. The IHS of claim 1, wherein the program instructions, upon execution, further cause the controller to generate a quantity of LUTs corresponding to a quantity of pixel lines of the LCD.

6. The IHS of claim 1, wherein the program instructions, upon execution, further cause the controller to:
generate a number of LUTs fewer than a number of pixel lines of the video stream; and
interpolate between alternate grey levels of two of the LUTs to calculate resulting grey levels usable to generate the one pixel line.

7. The IHS of claim 1, wherein to generate the plurality of LUTs, the program instructions, upon execution, further cause the controller to calculate: (i) a first luminance for each gray scale level, and (ii) a second grey scale level at the end of a current frame formed by pixel lines of the video stream.

8. A Response Time Compensation (RTC) method for a Liquid Crystal Display (LCD), the method comprising:
generating a plurality of Look-up Tables (LUTs), each LUT having alternate grey levels selected to implement RTC in a Liquid Crystal Display (LCD);
calculating grey levels for each of the LUTs, at least in part, based upon a pixel line of a video stream; and
in response a given LUT not producing a result that meets a selected grey level response target (GLRT), incrementing an offset margin value and recalculating the given LUT using the incremented offset margin value.

9. The RTC method of claim 8, further comprising, for each LUT, calculating the alternate grey levels corresponding to a position of the pixel line on the LCD, wherein each of the LUTs is configured to generate a luminance on its respective pixel line that progressively increases from a top pixel line to a bottom pixel line of the LCD.

10. The RTC method of claim 8, further comprising, for each LUT, calculating the alternate grey levels such that each of the LUTs generates the same level of luminance at the end of a strobe period of the LCD.

11. The RTC method of claim 8, further comprising generating a quantity of LUTs corresponding to a quantity of pixel lines of the LCD.

12. The RTC method of claim 8, further comprising:
generating a quantity of LUTs that is less than the quantity of pixel lines of the video stream; and
calculating the grey levels used to generate the pixel line by interpolating between the alternate grey levels of two of the LUTs.

13. The RTC method of claim 8, further comprising generating the LUTs, at least in part, by calculating: (i) a first luminance for each gray scale level, and (ii) a second grey scale level at the end of a current frame formed by pixel lines of the video stream.

14. A non-transitory memory storage device having program instructions stored thereon that, upon execution by a controller of a Liquid Crystal Display (LCD), cause the LCD to:
generate a plurality of Look-up Tables (LUTs), wherein each LUT comprises alternate grey levels selected to implement Response Time Compensation (RTC) in a Liquid Crystal Display (LCD), and wherein the alternate grey levels are determined, at least in part, based upon a pixel line of a video stream; and
in response to a result produced by a given LUT that meets a selected grey level response target (GLRT), record the given LUT.

15. The non-transitory memory storage device of claim 14, wherein the program instructions, upon execution, further cause the controller to, for each LUT, calculate the alternate grey levels corresponding to a position of the pixel line on the LCD.

16. The non-transitory memory storage device of claim 15, wherein each of the LUTs is configured to generate a luminance on its respective pixel line that progressively increases from a top pixel line to a bottom pixel line of the LCD.

17. The non-transitory memory storage device of claim 14, wherein the program instructions, upon execution, further cause the controller to, for each LUT, calculate the alternate grey levels such that each of the LUTs generates the same level of luminance at the end of a strobe period of the LCD.

18. The non-transitory memory storage device of claim 14, wherein to generate the LUTs, the program instructions, upon execution, further cause the controller to calculate: (i) a first luminance for each gray scale level, and (ii) a second grey scale level at the end of a current frame formed by pixel lines of the video stream.

* * * * *